United States Patent [19]

Björkman et al.

[11] Patent Number: 4,646,660

[45] Date of Patent: Mar. 3, 1987

[54] ARRANGEMENT IN APPARATUS FOR THE COMBUSTION OF WASTE GASES

[75] Inventors: Åke Björkman; Günther Jönsson, both of Karlskrona, Sweden

[73] Assignee: Lumalampan Aktiebolag, Karlskrona, Sweden

[21] Appl. No.: 807,271

[22] Filed: Dec. 10, 1985

[30] Foreign Application Priority Data

Dec. 28, 1984 [SE] Sweden ..... 8403482

[51] Int. Cl.[4] ..... F23G 7/06

[52] U.S. Cl. ..... 110/210; 110/250; 110/345; 431/5; 431/160; 431/208; 431/328

[58] Field of Search ..... 110/203, 206–207, 110/210–212, 235, 250, 260, 317–319, 345, 162; 431/208, 326–328, 347, 5, 160

[56] References Cited

U.S. PATENT DOCUMENTS

| | | | |
|---|---|---|---|
| 3,073,684 | 1/1963 | Williams, Sr. | 431/5 |
| 3,297,411 | 1/1967 | Dear | 431/160 |
| 3,754,869 | 8/1973 | Van Raden | 110/210 X |
| 4,038,032 | 7/1977 | Brewer et al. | 110/212 X |
| 4,054,418 | 10/1977 | Milles et al. | 110/203 X |
| 4,067,682 | 1/1978 | Lado | 431/160 X |
| 4,255,646 | 3/1981 | Dragoy et al. | 431/208 X |
| 4,481,889 | 11/1984 | Sikander et al. | 110/212 |
| 4,495,873 | 1/1985 | Blankenship | 110/250 |

FOREIGN PATENT DOCUMENTS

| | | | |
|---|---|---|---|
| 140028 | 11/1980 | Japan | 110/203 |

OTHER PUBLICATIONS

Swedish Application No. 8206846-1 (accompanied by English version in the form of U.S. Pat. No. 4,481,889).

*Primary Examiner*—Albert J. Makay
*Assistant Examiner*—Steven E. Warner
*Attorney, Agent, or Firm*—Frishauf, Holtz, Goodman & Woodward

[57] ABSTRACT

A combustion chamber (1; 101), is surrounded by a heater (4; 104), by means of which a constant temperature in the order of 850° C. can be maintained in the chamber (1; 101). The chamber (1; 101) has arranged therein devices (17, 18, 117) which, when the arrangement is in operation, partly obstruct the passage of gas through the chamber. The waste gases to be treated are introduced into the chamber (1; 101) through an inlet (2; 102) and the treated, residual waste gas is discharged from the chamber through an outlet (3; 103). The arrangement also includes a supply line (14,15,16, 114,115) for supplying pre-heated reaction medium to the interior of the chamber (1; 101).

20 Claims, 6 Drawing Figures

ARRANGEMENT IN APPARATUS FOR THE COMBUSTION OF WASTE GASES

The present invention relates to an arrangement in apparatus for burning waste gases deriving from destruction furnaces, combustion plants, or material processing plants and the like. The arrangement comprises a tubular combustion chamber which is incorporated as an integral part in a waste-gas duct extending from the plant whose waste gases are to be burned in order to degrade environmentally harmful compounds which would otherwise be released to atmosphere or the surroundings.

A number of industrial processes are effected in a manner considered optimal with respect to the product or products to be produced. The majority of these processes result in the generation of waste gases containing undesirable secondary products deriving from the process. These secondary products, or compounds, are harmful, inter alia, to the environmental flora and fauna, and hence the release of such products to atmosphere is prohibited. Consequently the waste gases must be cleansed or filtered in some suitable manner. Washing of waste gases or chemical precipitation of given definable substances therein are both cleansing methods long known in the art. In those fields where organic substances are produced, or where such products are to be degraded in suitable processes herefor, cleansing of the waste gases by means of chemical precipitation requires the application of a large number of process stages, resulting in significant plant investment costs, and therewith a greatly impaired production economy.

In view of this it has been suggested in recent times that it should be possible to burn waste-gases containing gaseous organic compounds at high temperatures, so as to break-down the aforesaid components or compounds, to form water vapor and carbondioxide. A closely related problem prevails when carrying out processes which include heat-treatment procedures and in which organic compounds are present in the form of impurities which are liable to condense in a later process stage and clog the process equipment.

The aforesaid conditions and circumstances prevail, for example, when destroying mercury batteries, which are normally encased in a plastics material. Since mercury is extremely poisonous to the environment, it must be recovered before the waste residue can be dumped. It is possible in present times to recover and treat more than 99.9999% of the mercury present in destruction processes of the aforesaid kind, with the aid of a well developed technique employing distillation under pulsating pressure. A method and apparatus for eliminating problems arising from gassified synthetic resin departing in the initial stages of the distillation process are described and illustrated in SE-A. No. 8206846-1.

It has been found in practice, however, that in certain temperature ranges gassified synthetic resins depart momentarily from the distillation chamber in such large quantities that the synthetic-resin vapors erupt through the front of the destruction flame in the known gas burner. In order to work efficiently, this burner must be run at extremely high temperatures, which are achieved through the input of expensive combustion gases.

The purpose of this known burner is to convert volatile organic substances formed in a pyrolysis chamber or process chamber, to carbon-dioxide and water, with the greatest possible efficiency.

This process is known as oxidation, as all are aware, i.e. a chemical process utilizing oxygen ($O_2$) (either in pure form, as atmospheric oxygen, or in oxygen-air mixtures) as an oxidant.

The oxidation of all forms of hydrocarbons can be illustrated by the reaction formula:

$$C_nH_{2n+2k} + \left(\frac{3n+k}{2}\right) O_2 \longrightarrow nCO_2 + (n+k)H_2O$$

In order to overcome the energy barrier in the process direction, the reacting substances, i.e. the reactants, normally need to acquire a given energy, i.e. activation energy $=E_a$.

If so much chemical potential energy (=reaction heat) is released that the other reactants in the system acquire the requisite minimum energy ($E_a$), i.e. so that the reaction is self-sustaining, the reaction is termed combustion.

In order to achieve combustion with, for example, the aid of liquid petroleum gas (gasol), it is necessary to mix the same with free oxygen or air in suitable proportions, and to heat the mixture to ignition temperature. A given condition for combustion (=self-sustaining oxidation) to take place, is that there is a lower and an upper limit, percent by volume, of gasol in free oxygen or air.

The combustion results in total (the result of the energy terms for the part reactions involved) to such high temperatures that the gases begin to glow, which the eye discerns as a flame. The flame temperature often lies at least 1000° C. above the ignition temperature of the fuel/air or fuel/oxygen mixture.

When treating, for example, mercury batteries, the organic material, inter alia polyethylene sealing rings, paper etc., is degraded thermally in a vacuum ($P_{tot}\sim 0.2$ bar). The rate at which degradation takes place, and therewith the rate at which fuel is generated, is mainly a function of the charge-temperature, although it is also influenced to some extent by other parameters, inter alia by defects in the structure of the polymer.

Consequently, the combustion chamber ("the oxidation chamber") of the burner must be so constructed that oxidation takes place with an efficiency close to 100%, even when the fuel content of the gaseous mixture (fuel+oxidant) falls below the given lower limit. During the "oxidation stage" of the process, there is supplied a constant flow of oxidant such as to provide in the combustion chamber a stoichiometric excess of oxygen ($O_2$) corresponding to at least 50% by volume, calculated on maximum fuel generation.

It will be understood from this that the conditions are such that the oxidation process is only able to result in combustion with a "stabilized flame", guaranteeing that the fuel is converted to carbon-dioxide and water, for a certain length of time during the process.

Consequently, the activation energy ($E_a$), required for optimal oxidation must be supplied to the reactants from an external source during the whole of the oxidation stage, so that each molecule overcomes the energy barrier in the direction of the reaction $$\text{hydrocarbon} \rightarrow CO_2 + H_2O$$

Extremely good results were obtained with practically 100% oxidation of the pyrolysis gases when carrying out a series of tests with "synthetic charges" containing scrap glass+PE-plastics+PS-plastics+paper, and with charges comprising different kinds of batteries, or accumulators (Hg-batteries+alkaline batteries+brownstone batteries). Important experiences were gained during these tests with respect to the design of the burner and combustion chamber.

The object of the present invention is to provide a burner arrangement for the total combustion of waste gases, and primarily such waste gases as those laden with hydrocarbons and deriving from destruction furnaces, combustion plants and process plants etc. To this end there is proposed in accordance with the invention an arrangement of the kind described in the introductory paragraph, which is mainly characterized in that the combustion chamber has a gas through-pass by labyrinth construction and is surrounded by a heater. Other characteristic features of the invention are set forth in the following claims.

The present invention will now be described in more detail with reference to an exemplifying burner arrangement according to the invention, intended for burning waste gases deriving from a mercury recovery plant in which plastic-encapsulated mercury batteries are destroyed, and with reference to the accompanying drawings, in which FIG. 1 is an axial sectional view of one embodiment of the invention;

Figure 1:
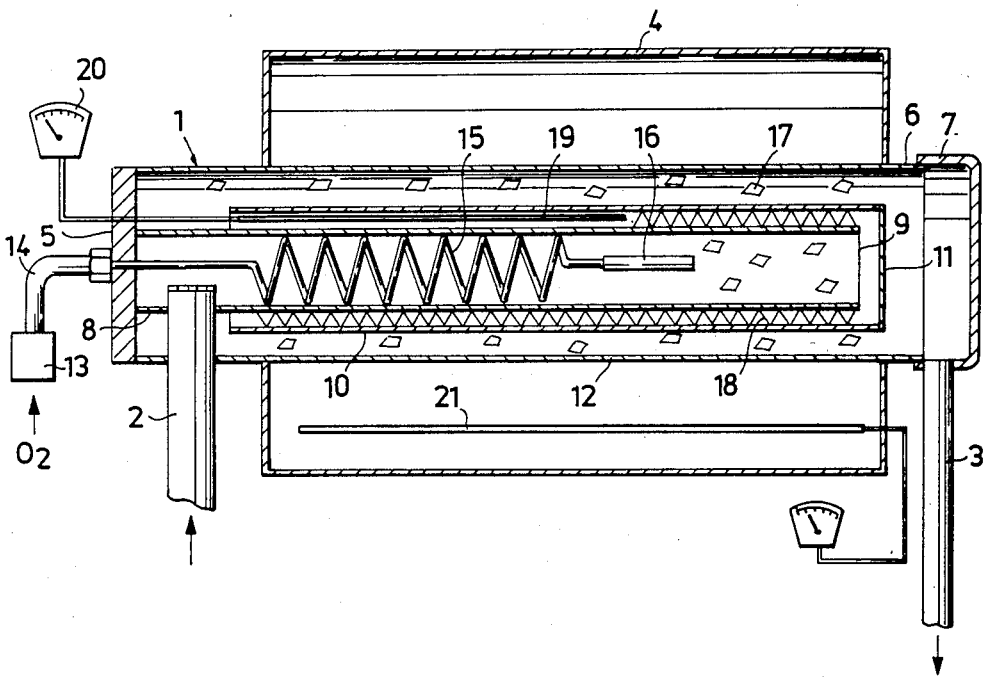

FIG. 1 illustrates a burner arrangement, comprising a combustion chamber 1 having an inlet 2 for waste gases to be burned and an outlet 3 for treated waste gases. The chamber 1 is surrounded along a greater part of its length by a heater 4, which is supplied with heat in a manner known per se, for example, by electricity, gas or in some other way. The manner in which heat is provided, however, has no decisive significance. It is important, however, that the heater 4 can be held constantly at a selected temperature, in the range of 800°-1100° C., with the aid of conventional control techniques.

The ends of the chamber 1 are located beyond the respective ends of the heater 4. The waste-gas inlet pipe 2, through which gases are passed, for example, from the treatment chamber of a mercury recovery plant, is tubular in shape and is connected for a first end 5 of the elongated combustion chamber 1. The outlet 3 for treated wastegases is connected to a second end 6 of the chamber 1, on the side of the heater 4 opposite the first chamber end 5. The second end 6 of the chamber 1 has fitted thereto a cover 7, which is held detachably in place by means of screws or in some other suitable manner.

As beforementioned, the chamber 1 is substantially of elongated, tubular configuration and exhibits internally a labyrinth construction, such as to provide the longest possible travel path through the chamber for the waste gases to be treated. This labyrinth constructions is achieved by placing tubes concentrically one within the other, with the ends of alternate tubes being closed. Thus, the waste-gas inlet pipe guides waste gases into an innermost tube 8 forming a first section of the combustion chamber 1. One end of the tube is connected in gas-tight fashion to the first end 5 of the chamber 1, with the other open end 9 of the tube facing towards the second end 6 of the chamber 1. Arranged axially around and concentrically with the innermost tube 8 is an intermediate tube 10. The tube 10 has a closed end 11 which covers the open end 9 of the innermost tube 8 while being spaced some centimeters therefrom, and extends along and around practically the whole length of said tube, with approximately the same radial clearance therebetween.

Arranged concentrically around the intermediate tube 10 is an outer tube 12, which is connected at one end thereof in a gas-tight fashion to the first end 5 of the chamber, and the other open end 6 of which lies in the vicinity of the outlet 3. The open end of the intermediate tube 10 terminates at a distance from the first end 5 of the chamber, therewith to provide a passage for waste gases into the outer tube 12 and thus terminate the through-passage or ducting for the treated waste gases, which exit through the outlet 3. The outlet 3 is normally connected to mercury cooling devices and condensors. Alternatively, when the burner is used to burn gases of a less harmful nature, the outlet 3 can discharge directly to the surroundings, or if it is suspected that sublimate or condensable inorganic substances may accompany the outgoing treated waste-gases, the outlet 3 can be connected to a plant for chemical precipitation of said compounds.

Practical tests have shown that when wishing to combust gasified, synthetic resins in waste gases of the kind in question it is sufficient merely to supply oxygen gas to the burner. Because the heating furnace 4 surrounding the combustion chamber 1 maintains the temperature in the reaction zone of the chamber at about 850° C., the inherent energy of the synthetic-resin vapor is able to trigger-off an exothermic reaction with solely an auxiliary supply of oxygen gas.

The oxygen-gas is fed into the chamber 1 by means of some suitable form of gas dispensing or metering device, shown generally at 13, for example a ROTAMETER® device, which provides the requisite quantity of oxygen gas needed for complete combustion of expected quantities of organic gases. The oxygen gas passes through a pipe 14, which extends helically as at 15 through the innermost tube 8 of the combustion chamber 1. The oxygen gas in the helical pipesection 15 is preheated to a temperature above 300° C., and exits through a ceramic flame tube 16 into the upstream-end of the innermost tube 8 of the chamber 1, as seen in the direction of gas flow in said tube. Arranged in this upstream-end of the tube 8, distal from the first end 5, is a large number of ceramic packing bodied 17 of high specific surface area, these bodies being heated to a glowing temperature (850° C.) by means of the heater 4.

The pressure in the combustion chamber should be kept as low as possible during the combustion process, which should be effected as close to vacuum conditions as possible. To this end there is connected downstream of the combustion chamber a vacuum pump capable of evacuating oxygen and generated gases of combustion, so as to avoid all risk of pressure build-up and possible explosion. These operational safety requirements are achieved with a balanced pressure which does not exceed 0.25 bar absolute pressure.

When gas generated by pyrolysis of synthetic resin materials passes over the packing bodies 17, these bodies impart the requisite ignition energy to the gas molecules. The surface characteristics of the respective packing bodies 17 therewith provide an extremely large number of "thermal ignition" points, and the ceramic material itself affords a certain catalytic effect.

In order to enable the aforesaid low pressure of maximum 0.25 bar absolute pressure to be maintained in the combustion chamber 1, the density to which the bodies 17 are packed is such that the total free cross-sectional area or intersticial area, between the bodies in the innermost tube 8 of the chamber 1 is equal to or greater than the through-flow area of the inlet 2, thereby achieving a conversion efficiency of synthetic resin vapor to water vapor and carbon-dioxide of <99%. The low pressure and the large number of cavities between the packing bodies 17 eliminate all risk of explosion due to increase in gas volume.

Upon continued reaction with the oxygen supplied, the waste gases to be treated penetrate further into the chamber 1 and enter the intermediate tube 10. As clearly shown in FIG. 1, there is mounted in the tube 10 a concertina-like net structure 18 through which the gases must pass. This net structure is made of metal wire or filament capable of withstanding high temperatures, and may suitably comprise, for example, stainless steel or an INCONEL brand alloy having a high nickel content. Positioned in the intermediate tube 10 is a thermoelement 19, which is connected to a control instrument 20, for example, a derivating-integrating-proportioning instrument adapted to control the supply of energy to the heater 4.

As the waste-gases leave the intermediate tube 10, under continued reaction with the oxygen gas, the gases are deflected into the outer tube 12 by the wall forming part of the first end 5 of the chamber. This outer tube is also filled with packing bodies 17, similar to the innermost tube 8. The terminal reactions take place between these packing bodies, such that all organic material is converted to water vapor and carbon-dioxide, which leave the chamber 1 through the outlet 3.

The thermal energy released during combustion of the pyrolysis gas with an auxiliary charge of oxygen ($O_2$) may result in the delivery to the heater 4 of such large quantities of surplus heat as to overheat the burner section thereof. In order to prevent this, the burner section, i.e. the section in which burner heat is generated, has arranged therein an additional thermoelement 21, which is connected so that the supply of electrical energy to said burner section is discontinued when temperatures of 1000° C.–1100° C. are detected. The heater 4 and the combustion chamber 1 are then heated solely by combustion energy, until the temperature falls to a level of about 850° C., whereupon external energy can again be supplied to the heater.

Figure 2:
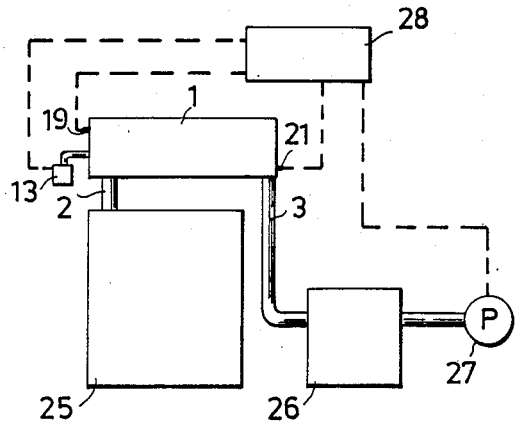
FIG. 2 is a schematic illustration of a mercury recovery plant.

FIG. 2 is a schematic illustration of a plant for recovering mercury from waste materials that also contain synthetic-resin material, and other organic substances. The chamber 1 receives waste gases from a heatable treatment chamber 25 through the waste-gas inlet 2. The residual, treated waste-gases freed from organic substances in the combustion chamber are discharged therefrom through the outlet 3 and conducted to a cooling trap 26, in which mercury is separated from said residual gases. A vacuum pump 27 is connected to the cooling trap 26, for generating a suitable underpressure in the plant. A control unit 28 is provided for controlling the process in response to signals from the thermoelements 19,21, the gas metering device 13 and the vacuum pump 27.

Figures 3, 3A, 3B, 3C:
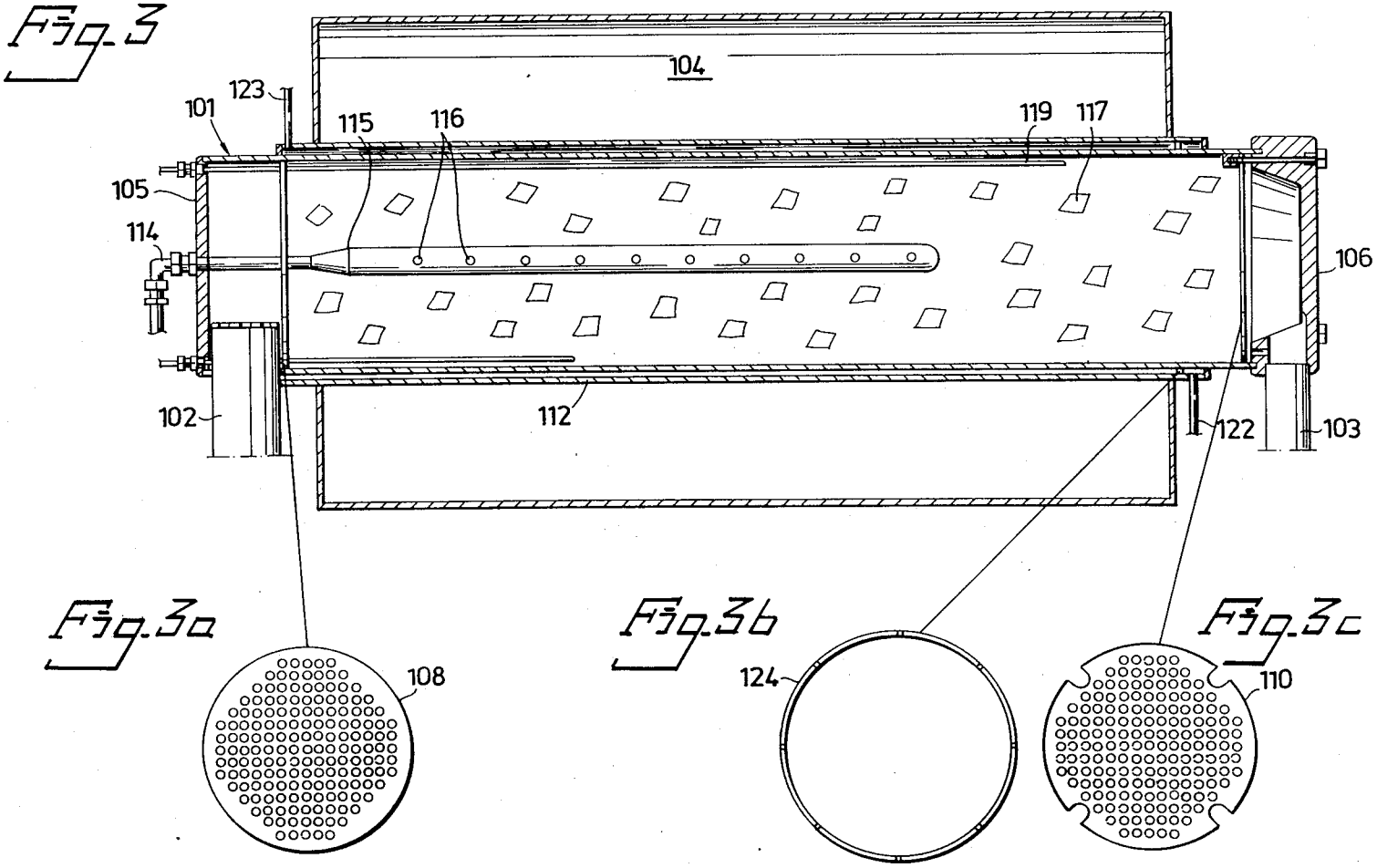
FIG. 3 is an axial sectional view of a further embodiment of the invention.
FIGS. 3A, 3B, 3C are plan views of distributing means located in the combustion chamber of the burner.

In the variant of the invention illustrated in FIG. 3, the concentrical tubes have been omitted. This further embodiment of the invention comprises a cooling jacket 112 arranged between the combustion chamber 101 and the heater 104, as illustrated. The combustion chamber of this embodiment is provided with an inlet 102 through which waste-gases taken from a pyrolysis chamber (not shown) are fed to the interior of the chamber 101. An oxygen-gas mixture of some suitable form is supplied in the aforedescribed manner through a pipe 114, which extends through the first end 105 of the combustion chamber 101. The pipe 114 widens in the chamber 101 and merges with a pipe 115, the end of which facing the second end 106 of the chamber 101 is closed. The pipe 115 is perforated along the whole of its length and around the circumference thereof, with apertures 116 of small diameter in relation to the diameter of the pipe 115. The pipe 115 extends through packing bodies 117, which fill the interior of the combustion chamber 101. An outlet 103 is provided at the second end 106 of the combustion chamber.

In order to ensure that the waste-gases to be treated in the combustion chamber are uniformly distributed over the whole cross-sectional area thereof, a perforated plate or disc 108 is positioned immediately downstream of the inlet 102. This disc, together with a corresponding disc 110 located at the other end of the chamber 101, also serves to hold the packing bodies 117 in place. Extending through the packing bodies 117 is a thermoelement 119, which sends signal to a control instrument in a manner similar to the thermoelements of the aforedescribed embodiment.

The cooling jacket 112 surrounding the combustion chamber 101 is provided with an inlet 122, located adjacent the second end 106 of said chamber. Cooling medium introduced into the cooling jacket 112 through the inlet 122 is conducted along the outer side of the chamber in accordance with the counter-flow principle. The coolant is discharged through an outlet channel 123 located adjacent the first end 105 of the chamber 101. A perforated distributor ring 124 is arranged adjacent the inlet 122, to ensure uniform distribution of the coolant, which in its simplest form comprises compressed air.

This external cooling with compressed air protects temperature-sensitive components of the combustion chamber against overheating. Cooling is effected in the gap between the chamber 101 and the cooling jacket 112. The cooling possibility thus provided is important inter alia, when treating in the chamber 25 waste containing polyethylene plastics, which has a very high calorific value when combusted. The external cooling provided also permits a higher flow of fuel to the combustion chamber (=increased oxidation capacity) without risk of overheating.

The external cooling has a further important function in respect of the process as a whole. During the oxidation stage, when the temperature in the combustion chamber has reached 925° C., the controlled rise in temperature in the pyrolysis chamber 25 ceases, this temperature rise normally being held at 0.5° C. per minute. Since the combustion chamber is enclosed in a heater, the possibility of self-cooling is minimal. Should the temperature in the combustion chamber increase to 940° C., as a result of a brief chemical-energy peak, the temperature is rapidly lowered by compressed-air cooling in the cooling jacket, down to 910° C. for example. The temperature then continues to rise in the pyrolysis chamber 25 in a normal manner, and the process can proceed as normal. The oxidation stage is made more effective in this way, and the process time considerably shortened.

If the temperature in the combustion chamber should increase too rapidly, subsequent to cooling being effected (>10° C. per minute) for example, from 910° C. to 925° C. in less than 1 minute, the temperature-rise control to the pyrolysis chamber is cut-out, and the temperature therein is held steady. A temperature increase in excess of 10° C. per minute indicates high fuel generation. When the temperature in the combustion chamber again reaches 930° C., the air-cooling procedure again automatically comes into function and cools said chamber to 910° C., whereafter the process continues as normal. External cooling is solely utilized to carry away thermal energy produced during the oxidation process. The aforedescribed control of the temperature in the combustion chamber and in the pyrolysis chamber constitutes an efficient method of controlling the emission of the gases to be converted to water vapour and carbon-dioxide in the combustion chamber. This enables the capacity of the combustion chamber to be optimised. Although the illustrated embodiment in FIG. 3 comprises solely one perforated pipe 115 connected to the oxygen-gas supply pipe 114, it will be understood that the supply pipe 114 may branch into a plurality of perforated pipes 115, so as to further improve distribution of the oxygen gas throughout the combustion chamber 101.

What is claimed is:

1. An arrangement in burners for combusting waste gases, primarily waste gases containing large quantities of hydrocarbons, deriving from destruction plants or the like, said arrangement comprising a combustion chamber (1; 101) having a gas through-flow passage and being incorporated in a waste-gas duct extending from the destruction plant, and provided with a waste gas inlet (2; 102), an outlet (3;103) for treated waste gases, supply means (13, 14, 15, 114, 115) for combustion-promoting media, the gas through-flow passage of the combustion chamber (1; 101) being of labyrinth construction, formed by an arrangement of obstructive devices (17, 18, 117), the combustion chamber (1) being surrounded by a heater (4; 104) and connected to a vacuum generating means (27) for creating a partial vacuum in the chamber (1; 101), wherein the obstructive devices include high-temperature resistant ceramic packing bodies (17; 117) of large specific surface area, and wherein arranged in the combustion chamber (101) immediately downstream of the inlet (102) and immediately upstream of the outlet (103) is a respective perforated disc or plate (108; 110) which extends at right angles to the longitudinal axis of the chamber (101).

2. An arrangement according to claim 1, wherein the combustion chamber (1; 101) is surrounded by a cooling jacket (112) which is sealed at its ends against the combustion chamber and which is provided with a coolant inlet (122) and a coolant outlet (123).

3. An arrangement according to claim 2, wherein said heater surrounds most of said combustion chamber.

4. An arrangement according to claim 3, wherein the supply of heat thereto is controlled by signals from a first thermoelement (19; 119) located in the combustion chamber (1; 101).

5. An arrangement according to claim 4, wherein the supply means for supplying combustion-promoting media to the arrangement comprises a plurality of pipes (115) each of which is closed at its inner end and extends through the combustion chamber (1; 101), and which is perforated around its peripheral surface and along the whole of its length with apertures (116) of small diameter in relation to the diameter of the pipe (115).

6. An arrangement in burners for combusting waste gases, primarily waste gases containing large quantities of hydrocarbons, deriving from destruction plants or the like, said arrangement comprising a combustion chamber (1; 101) having a gas through-flow passage and being incorporated in a waste-gas duct extending from the destruction plant, and provided with a waste gas inlet (2; 102), an outlet (3;103) for treated waste gases, supply means (13, 14, 15, 114, 115) comprising a tubular helix for combustion-promoting media, the gas through-flow passage of the combustion chamber (1; 101) being of labyrinth construction, formed by an arrangement of obstructive devices (17, 18, 117), the combustion chamber (1) being surrounded by a heater (4; 104) and connected to a vacuum generating means (27) for creating a partial vacuum in the chamber (1; 101), wherein the combustion chamber (1; 101) is surrounded by a cooling the chamber (101), wherein the combustion chamber (1; 101) is surrounded by a cooling jacket (112) which is sealed at its ends against the combustion chamber and which is provided with a coolant inlet (122) and a coolant outlet (123), wherein said heater surrounds most of said combustion chamber; wherein the supply of heat thereto is controlled by signals from a first thermoelement (19; 119) located in the combustion chamber (1; 101); and wherein the supply means for supplying combustion-promoting media to the arrangement comprises a plurality of pipes (115) each of which is closed at its inner end and extends through the combustion chamber (1; 101), and which is perforated around its peripheral surface and along the whole of its length with apertures (116) of small diameter in relation to the diameter of the pipe (115).

7. An arrangement according to claim 6, wherein said heater surrounds most of said combustion chamber.

8. An arrangement in burners for combusting waste gases, primarily waste gases containing large quantities of hydrocarbons, deriving from destruction plants or the like, said arrangement comprising a combustion chamber (1; 101) having a gas through-flow passage and being incorporated in a waste-gas duct extending from the destruction plant, and provided with a waste gas inlet (2; 102), an outlet (3;103) for treated waste gases, supply means (13, 14, 15, 114, 115) for combustion-promoting media, the gas through-flow passage of the combustion chamber (1; 101) being of labyrinth construction, formed by an arrangement of obstructive devices (17, 18, 117); the combustion chamber (1) being surrounded by a heater (4; 104) and connected to a vacuum generating means (27) for creating a partial vacuum in the chamber (1; 101), wherein the obstructive devices include high-temperature resistant ceramic packing bodies (17; 117) of large specific surface area, wherein arranged in the combustion chamber (101) immediately downstream of the inlet (102) and immediately upstream of the outlet (103) is a respective perforated disc or plate (108; 110) which extends at right angles to the longitudinal axis of the combustion chamber (1; 101) being of labyrinth construction, formed by an arrangement of obstructive devices (17, 18, 117), the combustion chamber (1) being surrounded by a heater (4; 104) and connected to a vacuum generating means (27) for creating a partial vacuum in the chamber (1; 101), and wherein the supply means for supplying combustion-promoting media to the arrangement comprises a plurality of pipes (115) each of which is closed at its inner end and extends through the combustion chamber (1; 101), and which is perforated around its peripheral surface and along the whole of its length with apertures (116) of small diameter in relation to the diameter of the pipe 115).

9. An arrangement in burners for combusting waste gases, primarily waste gases containing large quantities of hydrocarbons, deriving from destruction plants or the like, said arrangement comprising a combustion chamber (1; 101) having a gas through-flow passage and being incorporated in a waste-gas duct extending from the destruction plant, and provided with a waste gas inlet (2; 102), an outlet (3;103) for treated waste gases, supply means (13, 14, 15, 114, 115) for combustion-promoting media, the gas through-flow passage of jacket (112) which is sealed at its ends against the combustion chamber and which is provided with a coolant inlet (122) and a coolant outlet (123).

10. An arrangement in burners for combusting waste gases, primarily waste gases containing large quantities of hydrocarbons, deriving from destruction plants or the like, said arrangement comprising a combustion chamber (1; 101) having a gas through-flow passage and being incorporated in a waste-gas duct extending from the destruction plant, and provided with a waste gas inlet (2; 102), an outlet (3; 103) for treated waste gases, and supply means (13, 14, 15, 114, 115) for combustion-promoting media, the gas through-flow passage of the combustion chamber (1; 101) being of labyrinth construction, formed by an arrangement of obstructive devices (17, 18, 117), the combustion chamber (1) being surrounded by a heater (4; 104) and connected to a vacuum generating means (27) for creating a partial vacuum in the chamber (1; 101), wherein the gas flow-through passage is extended by means of mutually concentrically arranged tubes (8, 10, 12) having alternately closed ends, and wherein the supply means for supplying combustion-promotion media to the arrangement comprises a tubular helix (15) located in the first part of the innermost tube (8) of said mutually concentrically arranged tubes (8, 10, 12).

11. An arrangement according to claim 10, wherein the obstructive devices include a net structure (18) made of high-temperature resistant metal wire or filament.

12. An arrangement according to claim 10, wherein the tubular helix (15) is terminated with a high-temperature resistant flame tube (16).

13. An arrangement according to claim 10, wherein the obstructive devices include high-temperature-resistant ceramic packing bodies (17; 117) of large specific surface area.

14. An arrangement according to claim 13, wherein the total free cross-sectional area between the packing bodies (17; 117) is equal to or greater than the cross-sectional area of the inlet (2; 102).

15. An arrangement according to claim 10, wherein the heater (4;104) surrounding the combustion chamber (1; 101) is arranged to operate at a temperature of 800°-1100° C., preferably 850°-900° C.

16. An arrangement according to claim 15, characterized in that the supply of heat thereto is controlled by signals from a first thermoelement (9; 119) located in the combustion chamber (1;101).

17. An arrangement according to claim 15, wherein a second thermoelement (21) is arranged in the heater (4) for controlling the temperature therein.

18. An arrangement in burners for combusting waste gases, primarily waste gases containing large quantities of hydrocarbons, deriving from destruction plants or the like, said arrangement comprising a combustion chamber (1; 101) having a gas through-flow passage and being incorporated in a waste-gas duct extending from the destruction plant, and provided with a waste gas inlet (2; 102), an outlet (3; 103) for treated waste gases, and supply means (13, 14, 15, 114, 115) for combustion-promoting media, the gas through-flow passage of the combustion chamber (1; 101) being of labyrinth construction, formed by an arrangement of obstructive devices (17, 18, 117), the combustion chamber (1) being surrounded by a heater (4; 104) and connected to a vacuum generating means (27) for creating a partial vacuum in the chamber (1; 101), wherein the supply means for supplying combustion-promoting media to the arrangement comprises at least one pipe (115) which is closed at its inner end and extends centrally through the combustion chamber (1; 101), and which is perforated around its peripheral surface and along the whole of its length with apertures (116) of small diameter in relation to the diameter of the pipe (115).

19. An arrangement according to claim 18, wherein arranged in the combustion chamber (101) immediately downstream of the inlet (102) and immediately upstream of the outlet (103) is a respective perforated disc or plate (108,110) which extends at right angles to the longitudinal axis of the chamber (101).

20. An arrangement according to claim 18, wherein the combustion chamber (1; 101) is surrounded by a cooling jacket (112) which is sealed at its ends against the combustion chamber and which is provided with a coolant inlet (122) and a coolant outlet (123).

* * * * *